US011098979B2

(12) United States Patent
Hellweg et al.

(10) Patent No.: US 11,098,979 B2
(45) Date of Patent: Aug. 24, 2021

(54) RETAINING MECHANISM FOR A HOLSTER

(71) Applicant: THF Innovation Pty Ltd, Bayswater (AU)

(72) Inventors: Albert Hellweg, Bayswater (AU); Cale Euan Pearce, Bayswater (AU)

(73) Assignee: THF Innovation Pty Ltd, Bayswater (AU)

( * ) Notice: Subject to any disclaimer, the term of this patent is extended or adjusted under 35 U.S.C. 154(b) by 0 days.

(21) Appl. No.: 16/467,432

(22) PCT Filed: Dec. 5, 2017

(86) PCT No.: PCT/AU2017/051334

§ 371 (c)(1),
(2) Date: Jun. 6, 2019

(87) PCT Pub. No.: WO2018/102865

PCT Pub. Date: Jun. 14, 2018

(65) Prior Publication Data

US 2020/0072575 A1 Mar. 5, 2020

(30) Foreign Application Priority Data

Dec. 6, 2016 (AU) ..... 2016905020

(51) Int. Cl.
*F41C 33/02* (2006.01)

(52) U.S. Cl.
CPC ..... *F41C 33/0263* (2013.01); *F41C 33/0227* (2013.01)

(58) Field of Classification Search
CPC ..... F41C 33/0263; F41C 33/0227
See application file for complete search history.

(56) References Cited

U.S. PATENT DOCUMENTS 3,550,822 A * 12/1970 Lloyd ..... F41C 33/0245 224/193
5,641,102 A 6/1997 Hellweg
(Continued)

FOREIGN PATENT DOCUMENTS

AU 2011261175 B2 12/2011
EP 1382931 A1 1/2004

*Primary Examiner* — Derek J Battisti
(74) *Attorney, Agent, or Firm* — Roy Kiesel Ford Doody & North, APLC; Brett A. North

(57) ABSTRACT

A retaining mechanism for a holster includes a body (18) mountable to or integral with a holster, and a hood unit (40) rotatably mounted to the body. The hood unit configured for rotation about a first axis between a retaining condition in which it overlies a service item in the holster to prevent its withdrawal and a retracted condition in which the service item can be withdrawn. A hand-operable lever assembly (60) is rotatably mounted to the body and configured for rotation about a second axis. The lever assembly is operably engageable with the hood unit whereby rotation of the lever assembly effects rotation of the hood unit to its retracted condition and vice versa. The lever assembly includes a first, deflectable, portion (70) and a separate second, depressible, portion (80). These first and second portions are respectively selectively deflectable and depressible against respective first and second restoring bias forces to disengage the lever assembly from a lock formation (128) configured to lock the lever assembly against rotation and thereby the hood unit against rotation to its retracted condition.

Also disclosed is a blocking element (160) moveable from a position in which it impedes or obstructs the lever assembly. In another aspect, a portion (150) of the lever assembly is releasable restrained between a portion (128) of the hood unit and a portion (110) of the body.

16 Claims, 14 Drawing Sheets

(56) References Cited

U.S. PATENT DOCUMENTS

| | | | | |
|---|---|---|---|---|
| 5,820,003 | A | 10/1998 | Nichols | |
| 6,371,341 | B1 | 4/2002 | Clifton, Jr. | |
| 6,769,581 | B2 | 8/2004 | Rogers et al. | |
| 7,461,765 | B2 * | 12/2008 | French | F41C 33/0227 224/243 |
| 7,556,181 | B2 * | 7/2009 | Spielberger | F41C 33/0245 224/243 |
| 8,141,758 | B2 * | 3/2012 | Spielberger | F41C 33/0227 224/243 |
| RE44,428 | E | 8/2013 | Spielberger | |
| 8,602,275 | B1 | 12/2013 | Kiger et al. | |
| 8,807,404 | B1 | 8/2014 | Howell et al. | |
| 10,634,452 | B1 * | 4/2020 | Chester | F41C 33/0263 |
| 2005/0035163 | A1 | 2/2005 | French et al. | |
| 2006/0011680 | A1 | 1/2006 | Cook et al. | |
| 2006/0175366 | A1 | 8/2006 | Dekaise | |
| 2007/0181619 | A1 | 8/2007 | Seyfert et al. | |
| 2009/0014484 | A1 | 1/2009 | Spielberger | |
| 2009/0321480 | A1 | 12/2009 | Kincaid et al. | |
| 2011/0101063 | A1 | 5/2011 | Zusman | |
| 2013/0075435 | A1 | 3/2013 | Hellweg | |

* cited by examiner

RETAINING MECHANISM FOR A HOLSTER

CROSS REFERENCE TO RELATED APPLICATIONS

PCT patent application serial number PCT/AU2017/051334, international filing date Dec. 5, 2017 (published as WIPO Publication No. WO2018/102865) is incorporated herein by reference in its entirety.

FIELD OF THE INVENTION

This invention relates generally to the retention of holstered service items such as weapons. The invention will be described herein in relation to the retention of holstered handguns, but it will be understood that the invention has wider application.

BACKGROUND OF THE INVENTION

Handgun holsters are generally fitted with devices, often called holster locks, for guarding against inadvertent or unauthorised release of the handgun from the holster, for example through unintended dislodgement or through removal by a person with whom the bearer, typically a law enforcement officer, is engaged in a confrontation. It is of course desirable that these devices do not mitigate against rapid release and deployment of the weapon when it is needed to protect the bearer or others from imminent attack.

A typical holster in widespread use has a pair of straps, viz a top strap that wraps over the rear of the gun and a lateral strap that wraps transversely around the holster in the vicinity of the otherwise exposed trigger. Each of the straps is secured into position by a stud button. To remove the gun, a bearer must first flick open each stud: this requires two separate actions, one for each stud, that make it difficult to maintain a firm grip on the gun handle. This in turn limits the speed with which the gun can be removed, and the lack of a secure grip on the gun provides an opportunity for an adverse party to wrestle control of the gun.

In another holster system, there is a single upper strap pivotally connected at both ends to the holster body. When a release button at the side of the holster body is pushed, the action rotates the strap forward to allow the gun to be removed. A problem with this arrangement is that an adverse party standing in front of the gun bearer can actively rotate the strap forward, either directly or by engaging the release button, to enable free access to remove the gun. To counter this disadvantage, a releasable lock element may be included behind the release button: the lock element is pulled toward the rear of the holster to unlock the strap. In this case, an adverse party may still reach over the holster, push the lock release and proceed to remove the gun as previously described, while the lock release incurs an additional action that the gun bearer must remember to do when putting the gun away. This limits the speed at which the gun may be returned to the holster, and can result in a dangerously insecure gun if the bearer forgets to re-engage the lock release. Furthermore, even with this system, it is difficult to maintain a secure grip on the gun handle while operating the release mechanism.

U.S. Pat. No. 7,461,765 discloses a security hood assembly for a holster. A lever is operably coupled to the hood for driving the hood toward an open position to allow the service item to be removed from the holster. In some embodiments, the lever is latched to the hood when in the closed position to prevent the hood from being opened through direct manipulation of the hood.

International patent publication no. WO 2011/150468 is an earlier patent application by the present applicant. Similar to the US patent mentioned above, this patent application discloses a security hood assembly for a holster that includes a lever operably coupled to a hood unit for driving the hood toward an open position. In one embodiment, the lever is releasably locked to a body or housing of the mechanism by intermeshing teeth formations in the closed or retaining position. In another embodiment, the lever is latched to the hood in the closed or retaining position.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

It is an object of the invention to provide a retaining mechanism for a holster that addresses the twin objectives of being readily releasable by the bearer of the holster, but not conducive to unauthorised release of the service item from the holster.

SUMMARY OF THE INVENTION

In a first aspect, the present invention provides a retaining mechanism for a holster, comprising:

a body mountable to or integral with a holster;

a hood unit rotatably mounted to the body, the hood unit configured for rotation about a first axis between a retaining condition in which it overlies a service item in the holster to prevent its withdrawal and a retracted condition in which the service item can be withdrawn; and a hand-operable lever assembly rotatably mounted to the body and configured for rotation about a second axis, the lever assembly operably engageable with the hood unit whereby rotation of the lever assembly effects said rotation of the hood unit to its retracted condition and vice versa;

wherein the lever assembly includes a first, deflectable, portion and a separate second, depressible, portion, the first and second portions respectively selectively deflectable and depressible against respective first and second restoring bias forces to disengage the lever assembly from a lock formation configured to lock the lever assembly against said rotation and thereby the hood unit against said rotation to its retracted condition.

The first portion is preferably selectively deflectable in a first action to allow the second portion to be selectively depressible in a second subsequent action. In this embodiment, the first portion may releasably lock the second portion to prevent the second portion from being depressed until the first portion is deflected in the first action.

The first portion may be selectively deflectable in a first direction and the second portion may be selectively depressible in a second direction, the first direction being generally perpendicular to the second direction.

Advantageously, the first and second portions are respectively selectively deflectable and depressible by a single digit, preferably the thumb, in a substantially continuous movement. Additionally, the subsequent rotation of the lever assembly to rotate the hood unit to its retracted condition may be effected in the aforesaid substantially continuous movement.

The first, deflectable, portion preferably comprises a generally resilient material, which resilience advantageously provides the first restoring bias force. In a preferred embodiment, the first portion is in the form of a generally L-shaped tab.

The second, depressible, portion is preferably fitted at the outer end of, and is slidably mounted on, an elongate body of the lever assembly. In a preferred embodiment, the second portion is in the form of a generally U-shaped button dimensioned to receive a thumb.

The aforementioned second restoring bias force is advantageously provided by an internal compressible spring. The arrangement is preferably such that when the lever assembly is rotated, either by direct hand engagement or by rotation of the hood unit, the second restoring bias force snaps the lever assembly back into engagement with the lock formation when it reaches a home position corresponding to the retaining condition of the hood unit.

The lock formation is preferably provided by the hood unit and may be a catch or detent that releasably engages a projection on the lever assembly in the retaining condition.

In a second aspect, the present invention also provides a retaining mechanism for a holster, comprising:

a body mountable to or integral with a holster;

a hood unit rotatably mounted to the body, the hood unit configured for rotation about a first axis between a retaining condition in which it overlies a service item in the holster to prevent its withdrawal and a retracted condition in which the service item can be withdrawn;

a hand-operable lever assembly rotatably mounted to the body and configured for rotation about a second axis, the lever assembly operably engageable with the hood unit whereby rotation of the lever assembly effects said rotation of the hood unit to its retracted condition and vice versa, and a blocking element selectively moveable between a blocking position in which it impedes or obstructs access to the lever assembly and an open position in which the lever assembly is readily accessible to effect said rotation of the hood unit to its retracted condition and vice versa.

The blocking element preferably overlies the lever assembly, or a portion thereof, in the blocking position. The blocking element may be rotatably mounted to the hood unit and configured to rotate between the blocking position and the open position.

In a preferred embodiment, the blocking element includes an elongate body and is selectively contactable and rotatable by a digit, preferably the thumb, to rotate the blocking element between the blocking position and the open position and vice versa.

In a third aspect, the present invention also provides a retaining mechanism for a holster, comprising:

a body mountable to or integral with a holster;

a hood unit rotatably mounted to the body, the hood unit configured for rotation about a first axis between a retaining condition in which it overlies a service item in the holster to prevent its withdrawal and a retracted condition in which the service item can be withdrawn; and a hand-operable lever assembly rotatably mounted to the body and configured for rotation about a second axis, the lever assembly operably engageable with the hood unit whereby rotation of the lever assembly effects said rotation of the hood unit to its retracted condition and vice versa;

wherein in the retaining condition, a portion of the lever assembly is located between and releasably restrained from movement by a portion of the hood unit and a portion of the body, the hood unit portion and the body portion configured to positively lock the lever assembly against said rotation and thereby the hood unit against said rotation to its retracted condition.

In a preferred embodiment, the lever assembly portion comprises an elongate projection or extension of the lever assembly and the body portion comprises a similarly dimensioned elongate projection or extension of the body. In this embodiment, the hood unit portion is preferably a catch or detent.

Advantageously, the elongate projection of the lever assembly (or a portion thereof) is located or "sandwiched" between the elongate projection of the body and the catch or detent of the hood unit to thereby positively lock and releasably restrain the lever assembly and hood unit from movement in the retaining condition. The lever assembly portion may be disengaged from the hood unit portion and the body portion to effect said rotation of the lever assembly and thereby said rotation of the hood unit to its retracted condition.

In any of the aforementioned aspects of the invention, the hood unit preferably rotates about the first axis in a first direction, and the lever assembly preferably rotates about the second axis in a second direction, wherein the first direction is preferably generally opposite to the second direction. In a preferred embodiment, the hood unit preferably forwardly rotates about the first axis from the retaining condition to the retracted condition, and the lever assembly preferably rearwardly rotates about the second axis to effect said forward rotation of the hood unit to its retracted condition.

In any of the aforementioned aspects of the invention, the body of the retaining mechanism is preferably elongate and/or generally elliptical in form. The body preferably comprises a housing that includes a means to operably engage the lever assembly and hood unit. In one form, the means comprises a pair of intermeshing gear elements formed on or carried by the lever assembly and the hood unit.

In any of the aforementioned aspects of the invention, the lever assembly preferably comprises an elongate body projecting generally upwardly from the second axis in the retaining condition when the holster is being worn.

In any of the aforementioned aspects of the invention, the second axis is preferably offset from the first axis. In a preferred embodiment, the first and second axes are arranged so that, when the holster is being worn, the second axis is rearwardly of and below the first axis. The first axis is preferably generally parallel to the second axis.

In any of the aforementioned aspects of the invention, the body of the retaining mechanism is preferably mounted to or integral with an outside surface of the holster, and in the normally worn position, is preferably located between the holster and the bearer's body.

A retaining mechanism according to the invention may include one or more of the features described in relation to any of the aforementioned aspects.

In a fourth aspect, the invention also provides a holster including the retaining mechanism according to any one of the aforementioned aspects.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

DETAILED DESCRIPTION OF THE EMBODIMENTS

Figure 1B:
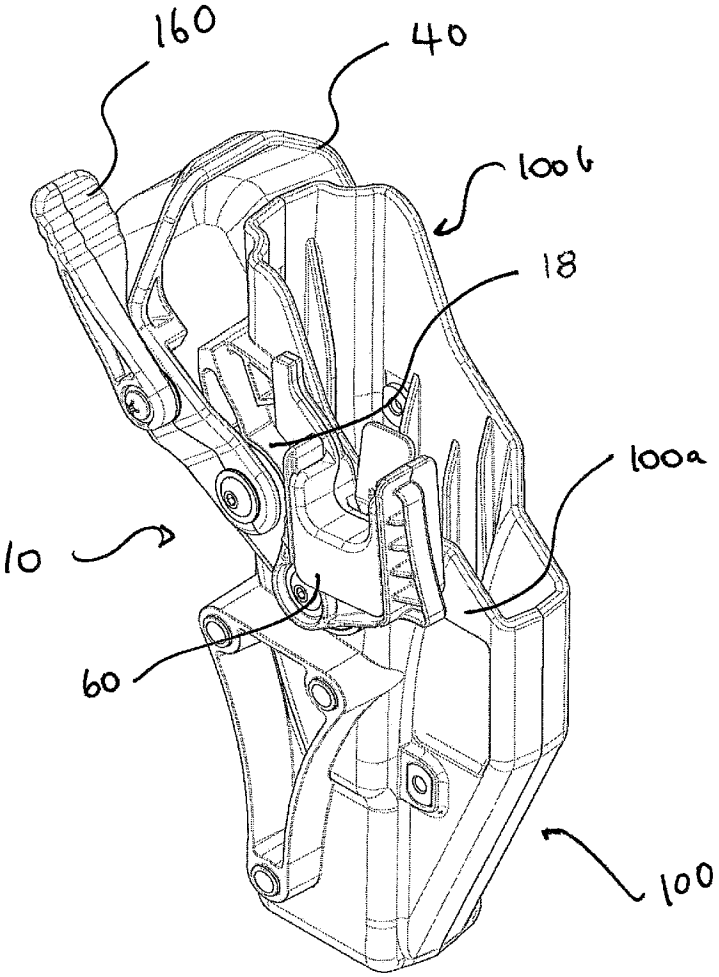
FIG. 1B is similar to FIG. 1A, but shows the retaining mechanism in a retracted condition.
Figure 1A:
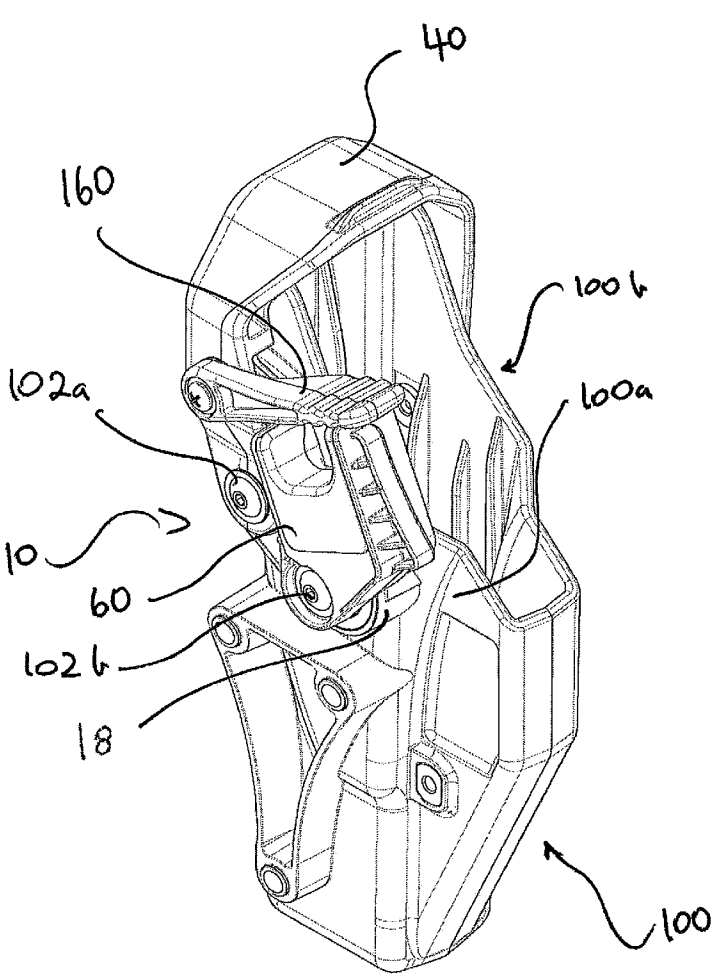
FIG. 1A is a perspective view of a retaining mechanism integral with a holster according to an embodiment of the invention.

The illustrated retaining mechanism, or holster lock, 10 includes a body 18, a hood unit 40, and a hand-operable lever assembly 60. In FIGS. 1A and 1B, the retaining mechanism 10 is shown integral with a holster 100 dimensioned to receive a service item, such as a handgun or the like. In a non-illustrated embodiment, the retaining mechanism may be mounted, for example releasably, to a holster.

In the manner described below, the hood unit 40 is rotatably mounted to the body 18 and holster 100 and is configured for rotation between a retaining condition (FIG. 1A) in which it overlies a service item in the holster (not shown) to prevent its withdrawal, and a forwardly retracted condition (FIG. 1B) in which the service item can be withdrawn from the holster 100. The lever assembly 60 is operably engagable with the hood unit 40 such that rearward rotation of the lever assembly 60 effects forward rotation of the hood unit 40 to its retracted condition and vice versa.

Figure 6:
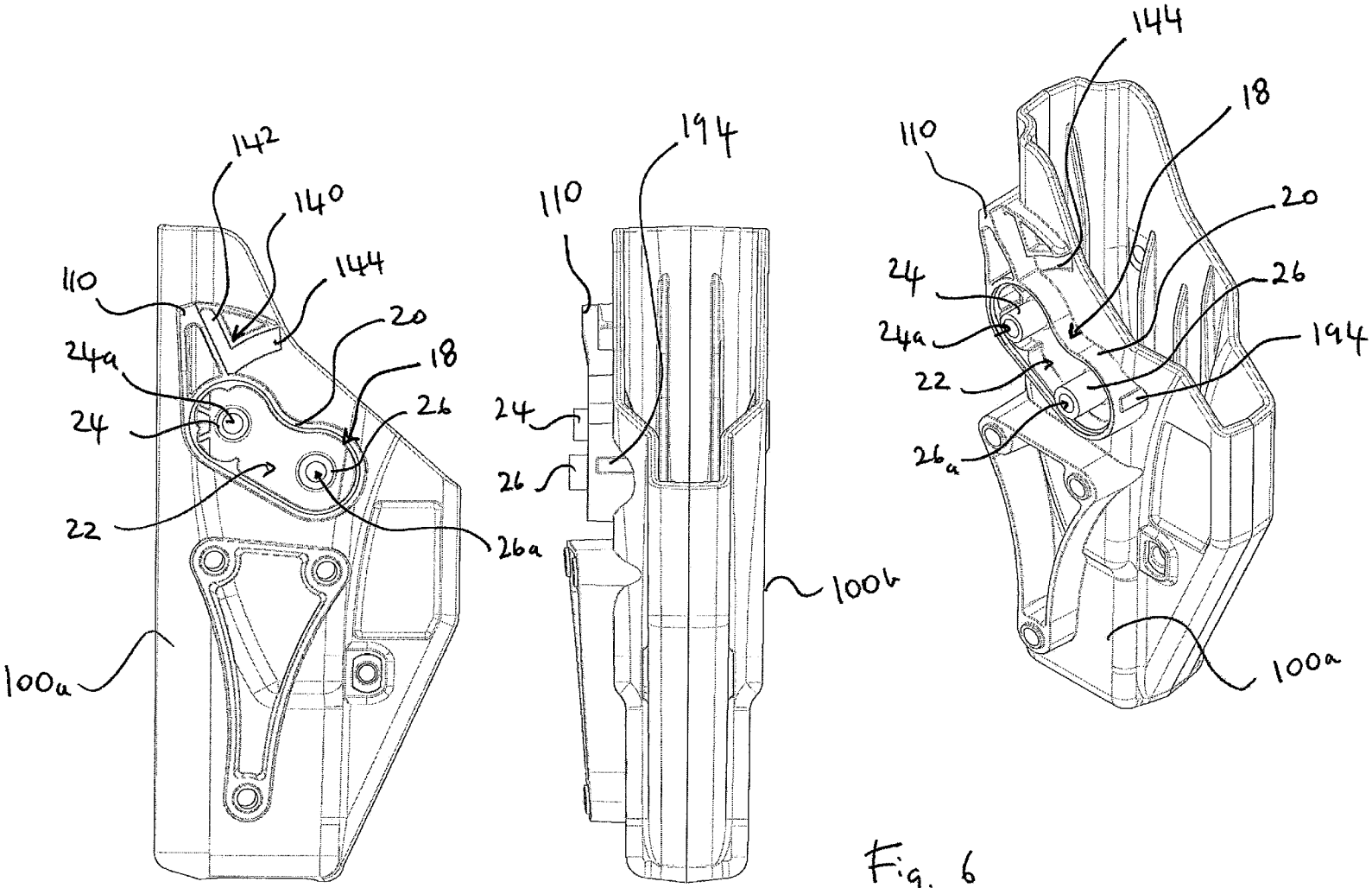
FIG. 6 shows various views of a housing of the retaining mechanism.

The body 18, best seen in FIG. 6, is of elongate and/or generally elliptical form and is inclined generally forwardly and upwardly (relative to a normally worn position of the holster 100). The body 18 is integral with a first, inner, side 100*a* of the holster 100. The body 18 comprises a housing 20 which defines an internal space 22 that includes a pair of outwardly projecting cylindrical bosses 24, 26, which bosses provide respective mounting axles for one side of the hood unit 40 and for the lever assembly 60. The bosses 24, 26 define respective circular blind bores 24*a*, 26*a* that extend though the bosses 24, 26. The bores 24*a*, 26*a* are dimensioned to receive threaded fasteners 102*a*, 102*b* (FIGS. 1A and 1B) and threaded nuts (not shown) for respectively mounting the hood unit 40 and lever assembly 60 to the retaining mechanism 10.

Figure 7:
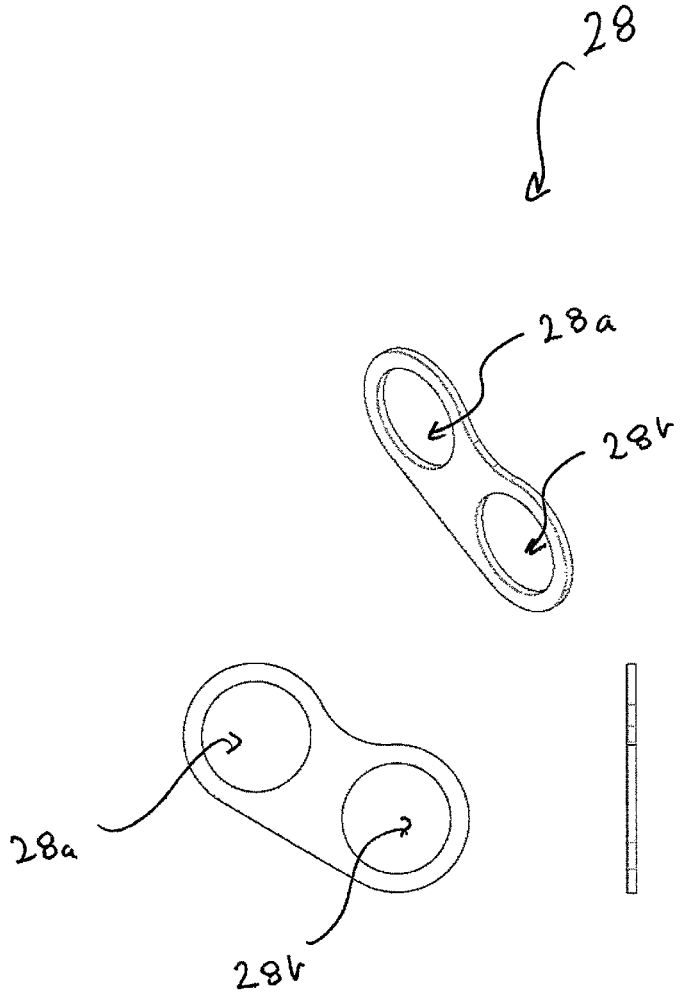
FIG. 7 shows various views of a cover of the housing of the retaining mechanism.
Figure 8A:
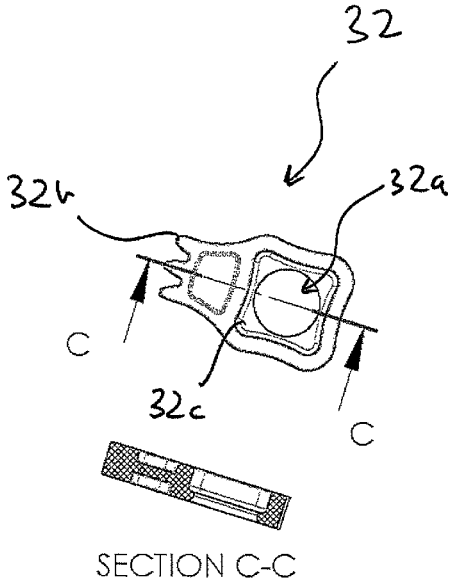
FIG. 8A shows a side and sectional view of a gear located in the housing of the retaining mechanism.
Figure 8B:
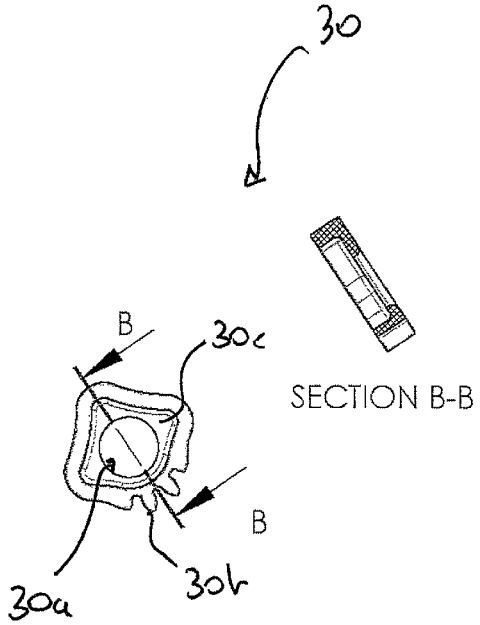
FIG. 8B shows a side and sectional view of a pinion located in the housing of the retaining mechanism.

The housing 20 includes a means to operably engage the lever assembly 60 with the hood unit 40 to effect the aforesaid rotation of the hood unit to its retracted condition and vice versa. In the illustrated embodiment, the means comprises a pinion 30 and gear 32 (FIGS. 8A and 8B). Pinion 30 is located within the internal space 22 of the housing 20 and is rotatably mounted on the boss 24 via a circular mounting aperture 30*a*. Similarly, gear 32 is located within the internal space 22 of the housing 20 and is rotatably mounted on the boss 26 via a circular mounting aperture 32*a*. The pinion and gear 30, 32 have respective intermeshing teeth 30*b*, 32*b* arranged along respective outer segments thereof such that rotation of the gear 32 in a first direction will cause rotation of the pinion 30 in a second opposite direction and vice versa. The pinion and gear 30, 32 are installed in the housing 20 and shielded from debris by a generally elliptical cover plate 28 (FIG. 7) that is interference fit in the housing 20 to close the internal space 22. The cover plate 28 has circular apertures 28*a*, 28*b* that are respectively co-axial with the bosses 24, 26 and which allow the bosses to project through the cover plate 28. As is described below, the pinion 30 is operably coupled to the hood unit 40, and the gear 32 is operably coupled to the lever assembly 60.

Referring to FIG. 6, the housing 20 also includes, at a forward end, an integral upstanding elongate tapered projection 110 that, in the manner described below, interfaces with a similar upstanding projection located on the lever assembly 60 to assist with releasably locking the lever assembly 60 against rearward rotation in the retaining condition and thereby preventing forward rotation of the hood unit 40. Adjacent the elongate tapered projection 110, along the inner side 100*a* of the holster 100, is a recessed L-shaped track 140 configured to guide the lever assembly 60 along a travel path between the retaining and retracted conditions (as is described below). The L-shaped track 140 includes a first track segment 142 generally parallel to a longitudinal axis of the tapered projection 110, and a second track segment 144 generally perpendicular to the longitudinal axis of the tapered projection 110.

Figure 9:
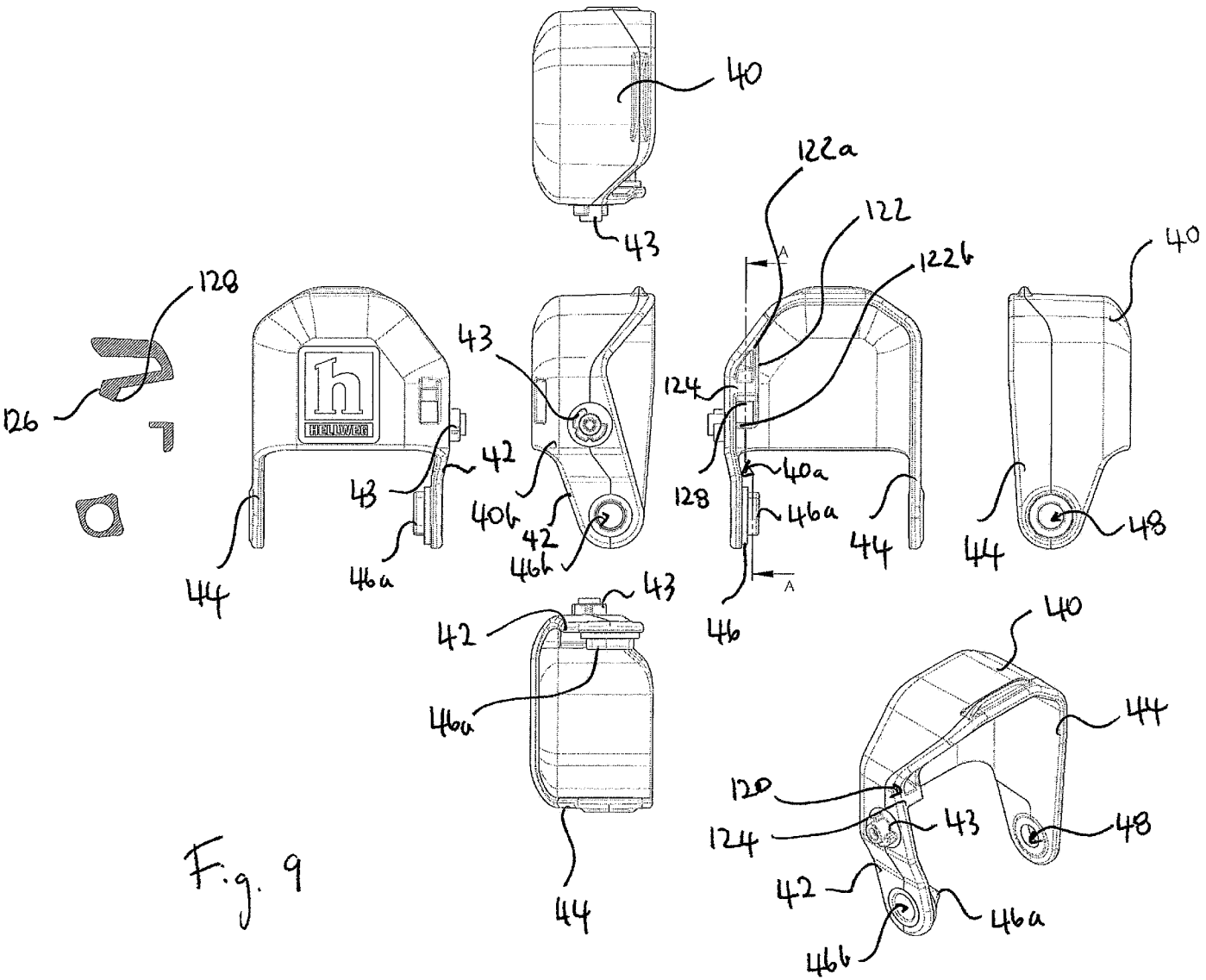
FIG. 9 shows various views of a hood unit of the retaining mechanism.

The hood unit 40, best seen in FIG. 9, is an integral one-piece moulding having a generally inverted U-shaped profile with respective arms 42, 44. Arm 42 has an integral collar 46 on an inner side surface 40*a* with a sector of splines 46*a* and a bore 46*b* by which it is rotatably mounted on boss 24. The splines 46*a* are dimensioned to be matingly located in an inner rebate or groove 30*c* of the pinion 30 (FIG. 8B) such that rotation of the hood unit causes likewise rotation of the pinion 30. Pinion 30 is retained in the housing 20 by cover plate 28 and fastener 102*a*, and the hood unit 40 is rotatably secured to the housing 20 by the fastener 102*a*. Arm 44 has a bore 48, aligned with bore 46*b*, by which it is rotatably mounted on and fastened to a projecting pin (not shown) on a second, outer, surface 100*b* of the holster 100 (opposite to the first, inner, surface 100*a*). The bore 46*b* with the boss 24 and bore 48 with the aforementioned projecting pin thereby define a first axis 12 about which the hood unit 40 is rotatable between the retaining condition (FIG. 1A) and the retracted condition (FIG. 1B).

Figure 14:
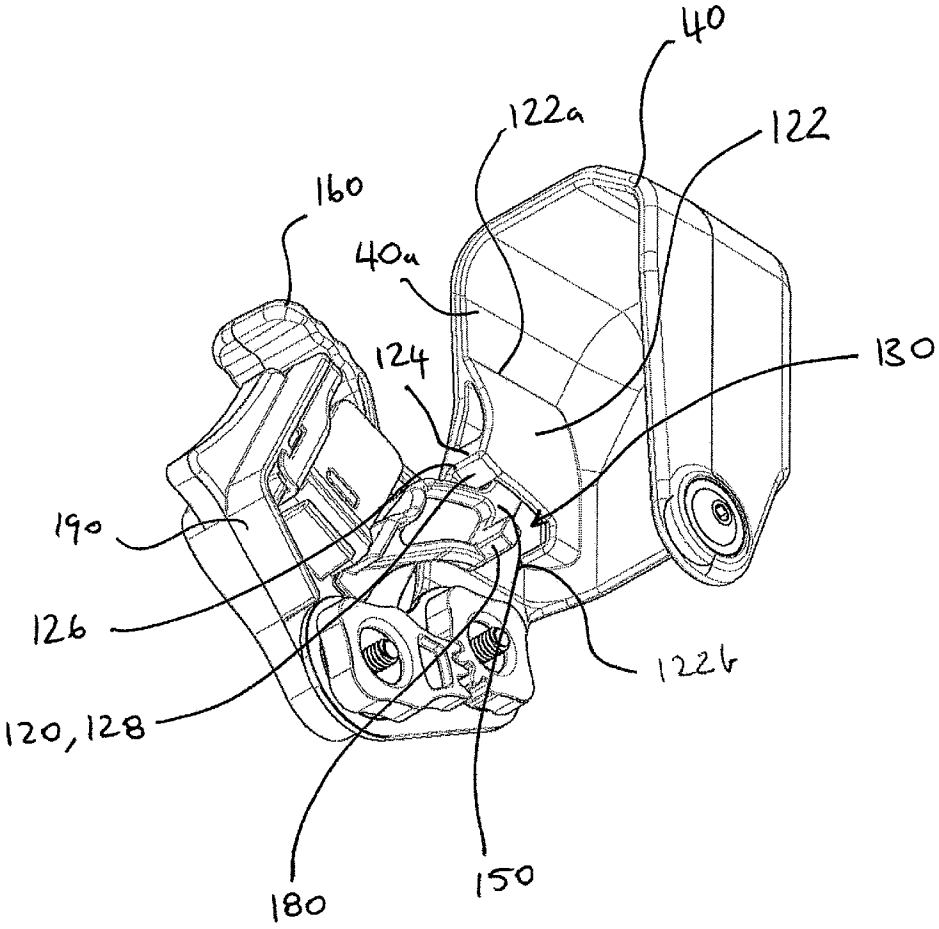
FIG. 14 is similar to FIG. 2 and shows a sectional and perspective view of the retaining mechanism in the retaining condition.
Figure 14:
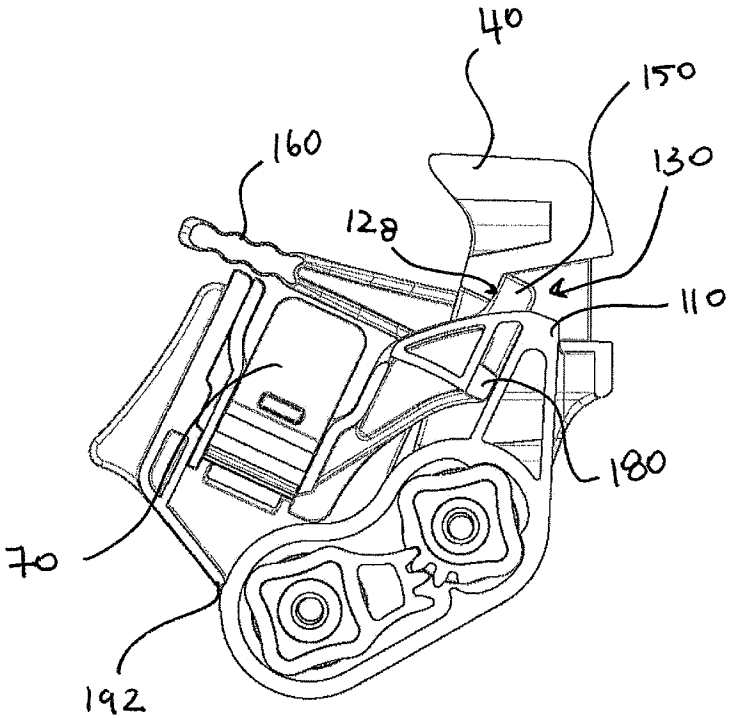

Referring to FIGS. 9 and 14, the hood unit 40 also includes, on the inner side surface 40*a* of arm 42, an integral panel 122 that is spaced from, and generally parallel to, the inner side surface 40*a*. The panel 122 is integral with the inner side surface 40*a* at upper and lower ends 122*a*, 122*b* respectively. Intermediate the upper and lower ends 122*a*, 122*b* of the panel 122 is a web 124 that extends between and joins an inner side surface of the panel 122 to the inner side surface 40*a* of the arm 42.

The web 124 defines, at a rearmost edge 126, a lock formation 120 in the form of a downwardly directed catch or detent surface 128. The detent surface 128 is configured to engage an upstanding elongate tapered projection 150 (FIG. 13) of the lever assembly 60 in the retaining condition to releasably lock the lever assembly 60 against rearward rotation and thereby prevent forward rotation of the hood unit 40. Together, the inner side surface 40*a* of the arm 42, an underside surface of the web 124, and the inner side surface of the panel 122 define a lock cavity 130 (FIG. 14) that receives the tapered projection 150 of the lever assembly 60 in the retaining condition. As is described in greater detail later, in the retaining condition (see the sectional view in FIG. 14), the elongate tapered projection 150 of the lever assembly 60 is located between, and releasably restrained from movement by, the detent surface 128 of the hood unit 40 and the elongate projection 110 of the housing so as to positively lock the lever assembly 60 against rearward rotation and thereby the hood unit 40 against forward rotation to the retracted condition. Additionally, the lock formation 120 prevents forced forward rotation of the hood unit 40 to the retracted condition by, for example, an adverse person attempting to expose the holstered item.

Figure 10:
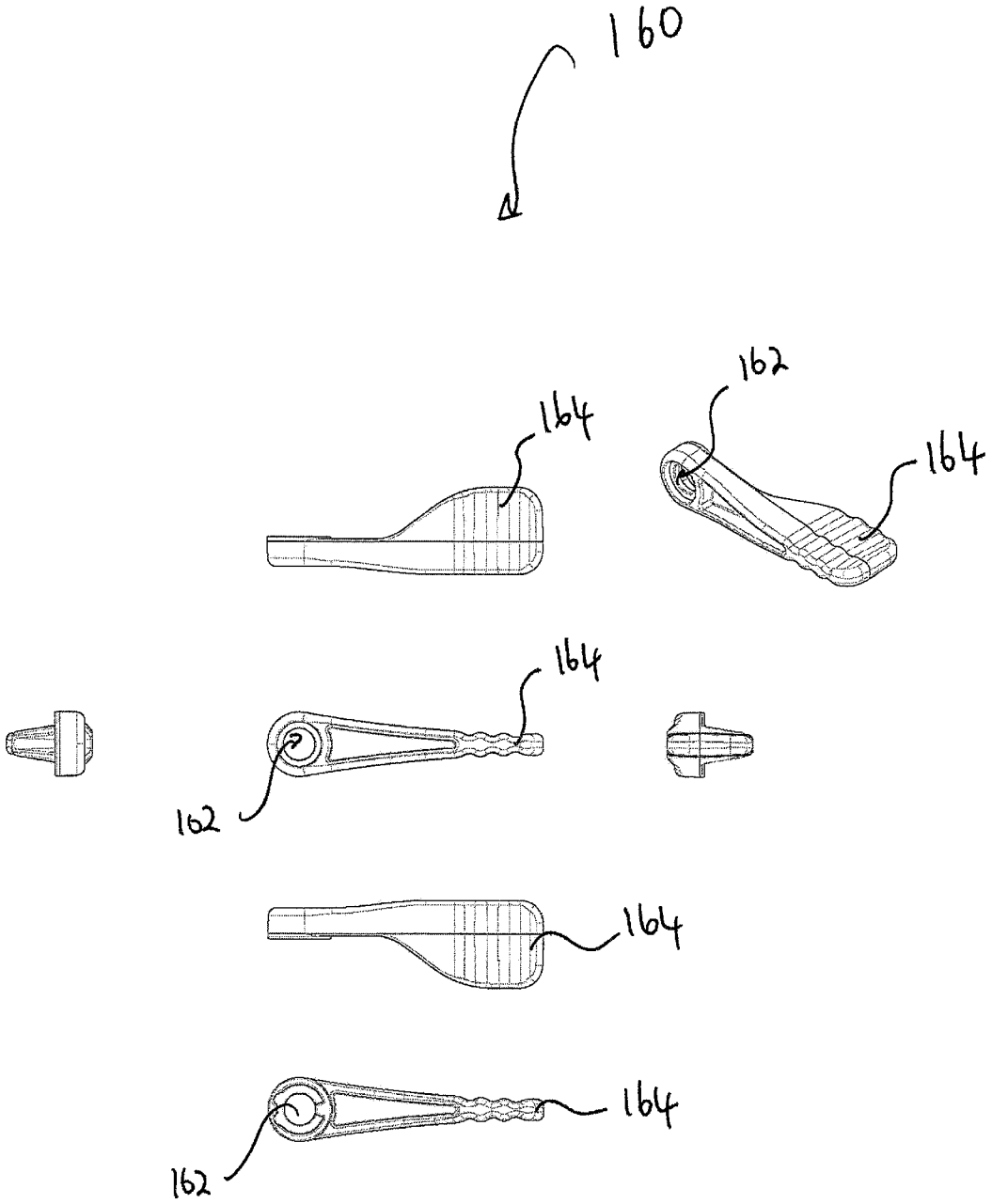
FIG. 10 shows various views of a blocking element mounted to the hood unit of FIG. 9.

The hood unit 40 also includes, on an outer side surface 40*b* of arm 42, a blocking element in the form of an elongate flap 160 (FIG. 10). The elongate flap 160 is selectively moveable between a blocking position (FIG. 2) in which it overlies lever assembly 60 to impede or obstruct access to the lever assembly 60, and an open position (FIG. 3) in which the flap 160 is retracted so that the lever assembly 60 is readily accessible by the bearer to effect rotation of the hood unit to its retracted condition and vice versa. The flap 160 includes a bore 162 by which it is rotatably mounted to a boss 43 located on the outer side surface 40*b* of arm 42 above bore 46*b*. The flap 160 tapers from bore 162 in a first dimension and widens in a second dimension to define, across approximately two-thirds of its length, a paddle-like undulating contact surface 164. Advantageously, the paddle 164 is dimensioned to be contactable by a digit, preferably the thumb (or a knuckle thereof), to rotate the flap 160 between the blocking position and the open position.

The lever assembly 60 includes a generally inverted U-shaped body 62 (FIG. 11) with respective arms 64, 66. Similar to the hood unit 40, arm 64 of the U-shaped body 62 includes an integral collar 68 on an inner side surface 60*a* with a sector of splines 68*a* and a bore 68*b* by which it is rotatably mounted on boss 26. The splines 68*a* are dimensioned to be matingly located in an inner rebate or groove 32*c* of the gear 32 (FIG. 8A) such that rotation of the lever assembly 60 causes likewise rotation of the gear 32. The gear 32 is retained in the housing 20 by cover plate 28 and fastener 102*b*, and the U-shaped body 62 is rotatably secured to the housing 20 by the fastener 102*b*. The bore 68*b* defines with boss 26 a second axis 14 by which the lever assembly 60 is rotatable to thereby drive the hood unit between the retaining condition and the retracted condition and vice versa. As is illustrated throughout the figures, the U-shaped body 62 projects generally upwardly from the second axis 14 in the retaining condition when the holster 100 is being worn. Additionally, as can be seen in FIGS. 1A and 1B, the second axis 14 is offset from the first axis 12 such that, when the holster 100 is being worn, the second axis 14 is rearwardly of and below the first axis 12.

The arm 66 of the U-shaped body 62 includes an integral lateral wall 190 that projects inwardly (towards the holster 100) and extends along the arm 66 from an uppermost edge and terminates in a generally rectangular surface 192 approximately adjacent the collar 68 (the surface 192 is generally rectangular when viewed from a side perpendicular to the inner surface 60*a*). The terminating surface 192 is dimensioned to interface with a generally rectangular raised detent surface 194 located along an outer surface of the housing 20 nearby boss 26. The terminating surface 192 is configured to engage the raised detent surface 194 and provide a restriction to rotation of the lever assembly 60 from the retaining condition (FIG. 1A) to the retracted condition (FIG. 1B) and vice versa. Advantageously, the surface 192 and raised detent 194 are dimensioned such that a positive rearwardly-directed rotational force is required to rotate the lever assembly 60 between the retaining and retracted positions, thereby preventing any inadvertent lever assembly movement. Additionally, the surface 192 and raised detent 194 provide some resistance to closing the hood unit 40 from the retracted condition to the retaining condition to prevent any inadvertent hood unit movement.

Figure 12:
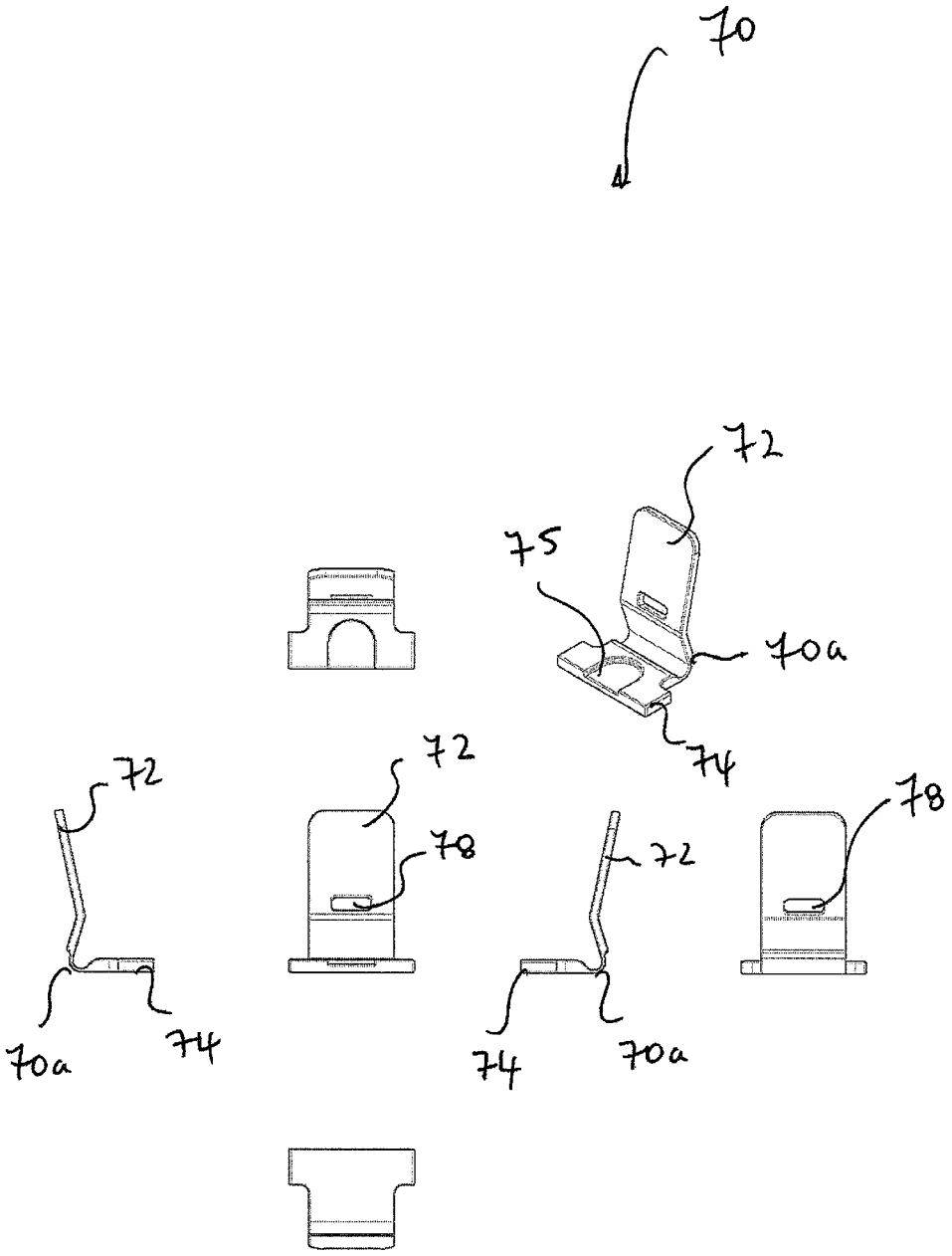
FIG. 12 shows various view of a first, deflectable, portion of the lever assembly.

Referring to FIG. 12, the lever assembly 60 further includes a first, deflectable, portion in the form of a generally L-shaped tab 70 (the tab 70 is generally L-shaped when viewed in side cross-section). The L-shaped tab 70 is of rounded rectangular form and includes an upstanding portion 72 which forms an angle of approximately 75° with a lower portion 74. The lower portion 74 is held in position adjacent a flat surface 62*a* of the U-shaped body 62, which surface 62*a* is generally perpendicular to, and defined between, the arms 64, 66. The inner surfaces 64*a*, 66*a* of respective arms 64, 66 define, at the junction of surface 62*a*, opposite concave recesses 62*b* in which outer side edges of the lower portion 74 of the L-shaped tab 70 is interference fit.

The L-shaped tab 70 comprises a generally resilient material, which resilience advantageously provides, at its bend/hinge 70*a*, a first restoring bias force against which the upstanding portion 72 of the L-shaped tab 70 is laterally deflectable (as is described below). In the illustrated embodiment, the L-shaped tab comprises a suitable plastic, but may comprise any other suitably resiliently flexible material known to persons skilled in the art.

Figure 11:
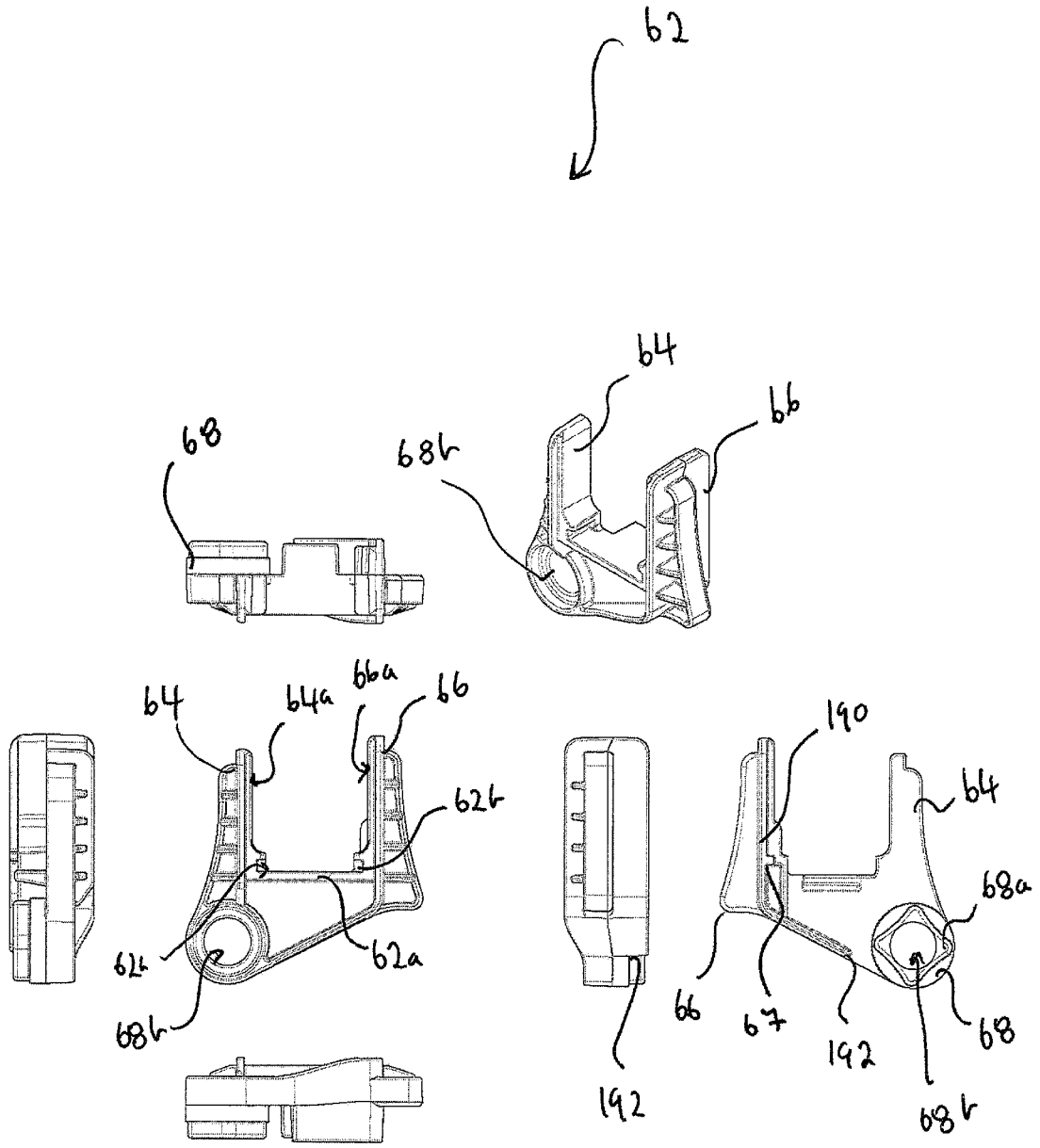
FIG. 11 shows various views of a component of the lever assembly of the retaining mechanism.
Figure 13:
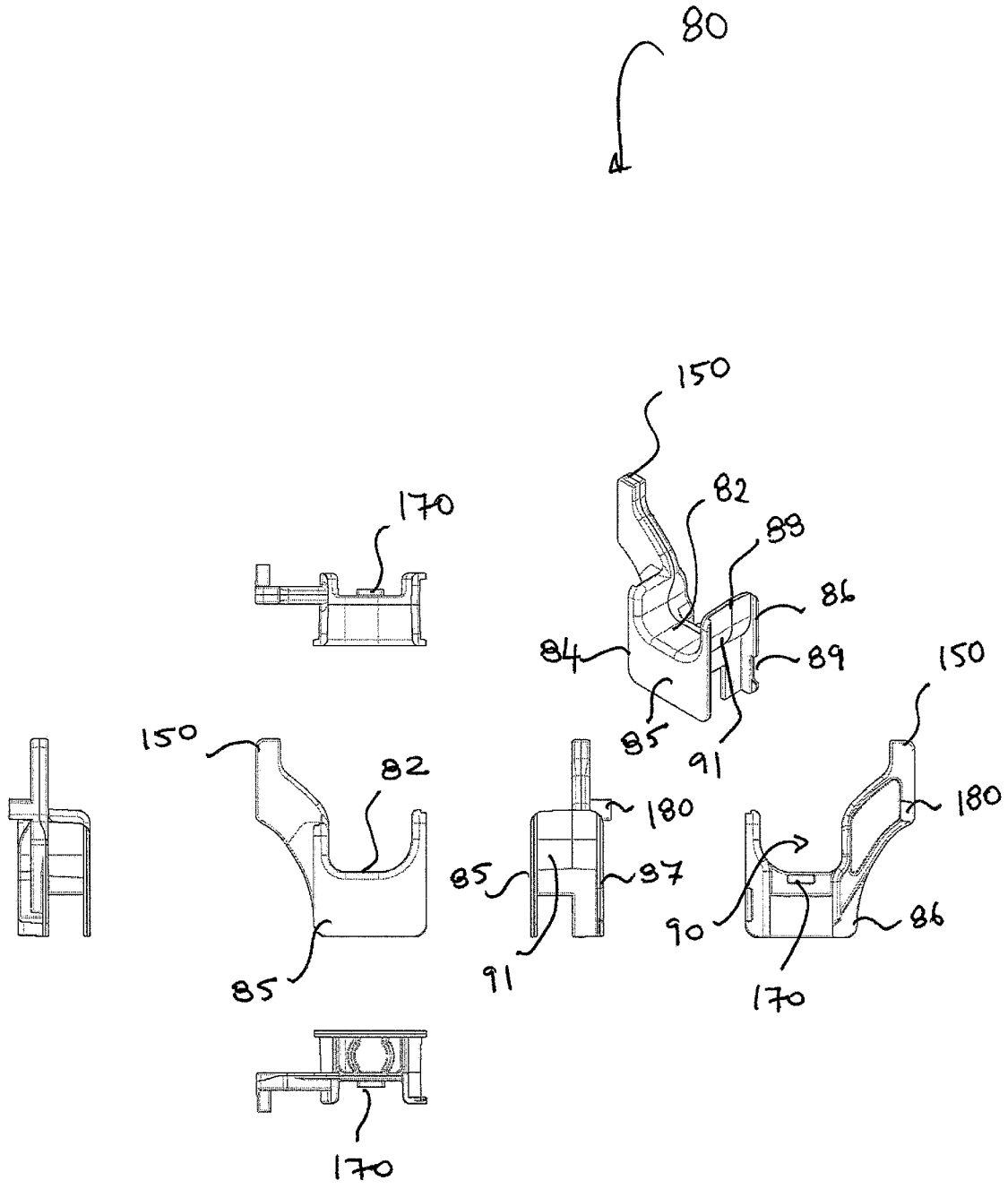
FIG. 13 shows various views of a second, depressible, portion of the lever assembly.

Referring to FIG. 13, the lever assembly 60 also includes a second, depressible, portion in the form of a generally U-shaped button 80 (the button 80 is generally U-shaped when viewed front-on). The button 80 is slidably mounted within the U-shaped body 62 and is an integral moulding comprising a generally U-shaped portion or seat 82 dimensioned to receive a digit, preferably a thumb. The U-shaped portion 82 includes flanges 84, 86 defined on respective opposite front 85 and rear 87 faces thereof. The rear flange 86 includes a generally rectangular cut-out 90 dimensioned to bound the upstanding portion 72 of the L-shaped tab 70. The flanges 84, 86 and an intermediate outside surface 88 of the U-shaped portion 82 define an outer curved ramp or sliding surface 91, said surface 91 defining a slide path upon which the U-shaped button 80 is slidably mounted to the inner surfaces 64*a*, 66*a* of the arms 64, 66 of the U-shaped body 62 (FIG. 11). In this arrangement, the second, depressible, portion or U-shaped button 80 is fitted at the outer end of, and is slidably mounted on, the U-shaped body 62 of the lever assembly 60. As is illustrated throughout the figures, the first portion or L-shaped tab 70 is deflectable in a first direction generally toward the holster 100 (or holstered item), and the second portion or U-shaped button 80 is depressible in a second direction generally downwardly in the normal worn position, i.e., perpendicular to the first direction.

The lever assembly 60 is constructed such that the lower portion 74 of the L-shaped tab 70 is disposed between the flat surface 62*a* of the U-shaped body 62 and the intermediate surface 88 of the depressible U-shaped button 80. The upstanding portion 72 of the L-shaped tab 70 is located in the rectangular cut-out 90 as described above, and is laterally deflectable relative thereto.

The depressible U-shaped button 80 also includes an upstanding elongate tapered projection 150 (FIG. 13) integral with one side of rear flange 86. The elongate projection 150 is dimensioned to engage the detent or catch surface 128 of the lock cavity 130 of the hood unit 40 in the retaining condition. The tapered projection 150 is selectively disengaged from the detent 128 (FIG. 9) by depressing the U-shaped button 80 against a second restoring bias force (described below).

The lever assembly 60 also includes an internal compressible spring (not shown) located between the intermediate outside surface 88 of U-shaped button 80 (FIG. 13) and a semi-circular indent 75 (FIG. 12) in an upper surface of the lower portion 74 of tab 70. Advantageously, the compressible spring provides the second restoring bias force against which the U-shaped button 80 is depressed. In the retaining condition (FIGS. 1A and 2), the compressible spring biases the U-shaped button 80 upwardly such that its uppermost edges are adjacent uppermost edges of the arms 64, 66 of the U-shaped body 62. During assembly of the retaining mechanism 10, the U-shaped portion 82 of the depressible button 80 is restrained from further upward movement beyond this outermost position by a projecting detent 67 (FIG. 11) located near the mid point of lateral wall 190 that operably engages a corresponding cut-out 89 (FIG. 13) located near the lowermost rear edge of the inner flange 86 of the U-shaped portion 82 of the depressible button 80.

The U-shaped button 80 also includes a generally rectangular lateral projection 170 having rounded corners, which projection 170 extends from rear face 87. The lateral projection 170 is received in a matching transverse slot 78 (FIG. 12) in the upstanding portion 72 of the L-shaped tab 70 in the retaining condition. In this manner, the first, deflectable, portion or L-shaped tab 70 releasably locks the second, depressible, portion or U-shaped button 80 from being depressed in the retaining condition until the upstanding portion 72 of the resilient tab 70 is deflected through the rectangular cut-out 90 in a first action. Once the upstanding portion 72 has been laterally deflected against its restoring bias force to a sufficient extent, the lateral projection 170 is no longer restrained in slot 78, and the U-shaped button 80 may be depressed in a second subsequent action against its restoring bias force (the spring at the intermediate surface 88). As is described above, as the U-shaped button 80 is depressed, the elongate tapered projection 150 is removed from engagement with the detent or catch surface 128 of the hood unit 40 to thereby allow the lever assembly 60 to be rotated rearwardly. As the lever assembly 60 is rotated rearwardly, gear 32 drives pinion 30 to thereby forwardly rotate the hood unit 40 to the retracted condition.

The elongate tapered projection 150 of the U-shaped button 80 also defines a laterally projecting guiding pin 180 on its rear, or inner, face approximately level with the uppermost edges of the U-shaped seat 82. The guiding pin 180 is dimensioned to travel along track segments 142, 144 of the L-shaped track 140 (FIG. 6) to thereby guide the movement of the lever assembly 60 between the retaining and retracted positions. In particular, the U-shaped button 80 of the lever assembly 60 travels along track segment 142 as the U-shaped button 80 is selectively depressed in the second action (following the lateral deflection of the L-shaped tab 70 in the first action). The lever assembly 60 then travels along track segment 144 as the lever assembly 60 is rotated rearwardly from a position corresponding to the retaining condition of the hood unit 40 to a position corresponding to the retracted condition of the hood unit 40. Importantly, as the hood unit 40 is caused to rotate rearwardly to the retaining condition, the guiding pin 180 travels along the track segment 144 thereby guiding the elongate projection 150 of the U-shaped button 80 into the lock cavity 130 to engage the downwardly directed catch/detent 128.

Figure 2:
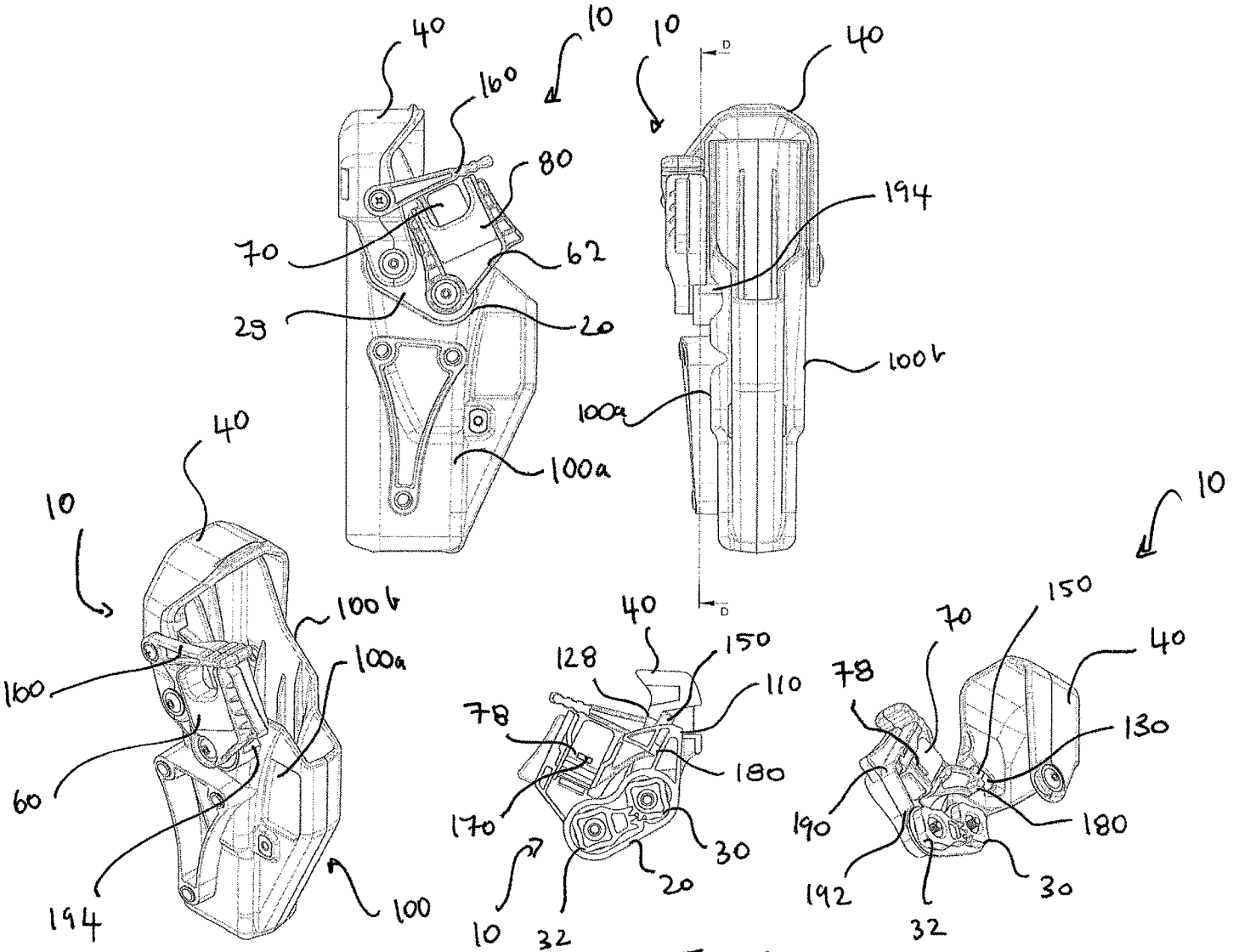
FIG. 2 shows various views of the retaining mechanism and holster of FIG. 1A.
Figure 3:
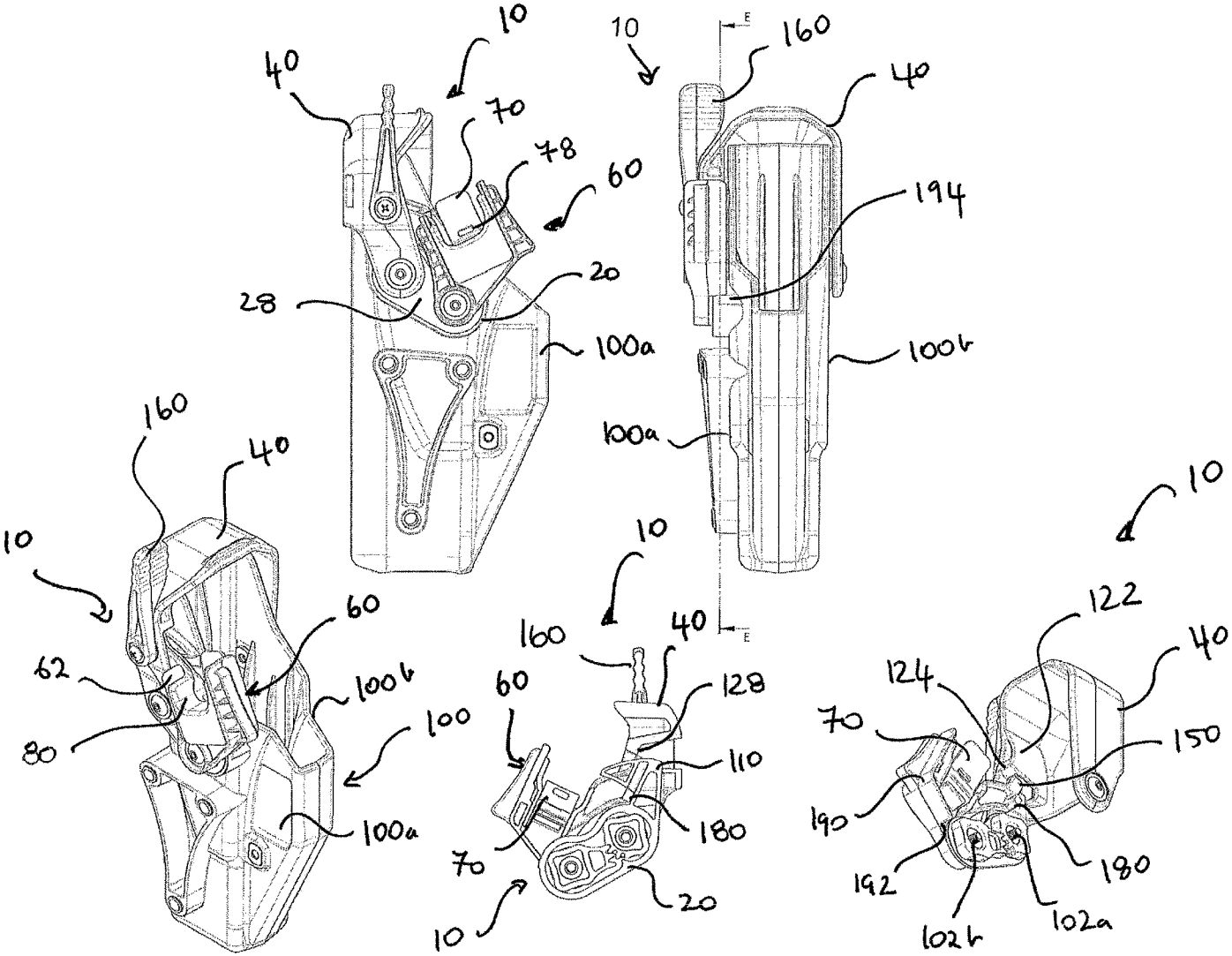
FIG. 3 shows various views of the retaining mechanism and holster with a lever assembly of the retaining mechanism in an unengaged or unlatched position.
Figure 4:
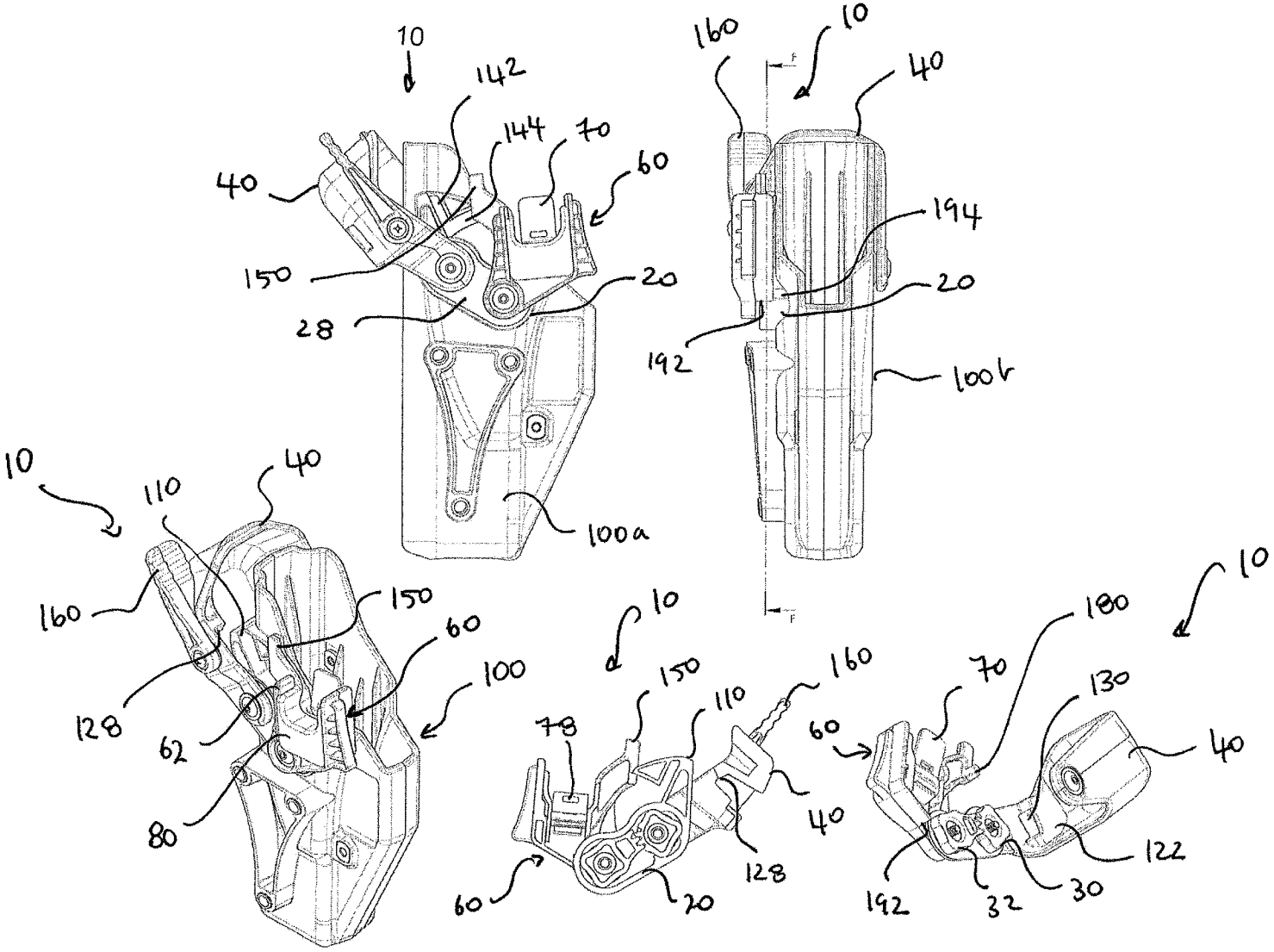
FIG. 4 shows various views of the retaining mechanism and holster of FIG. 1B.
Figures 5A, 5B, 5C, 5D, 5E:
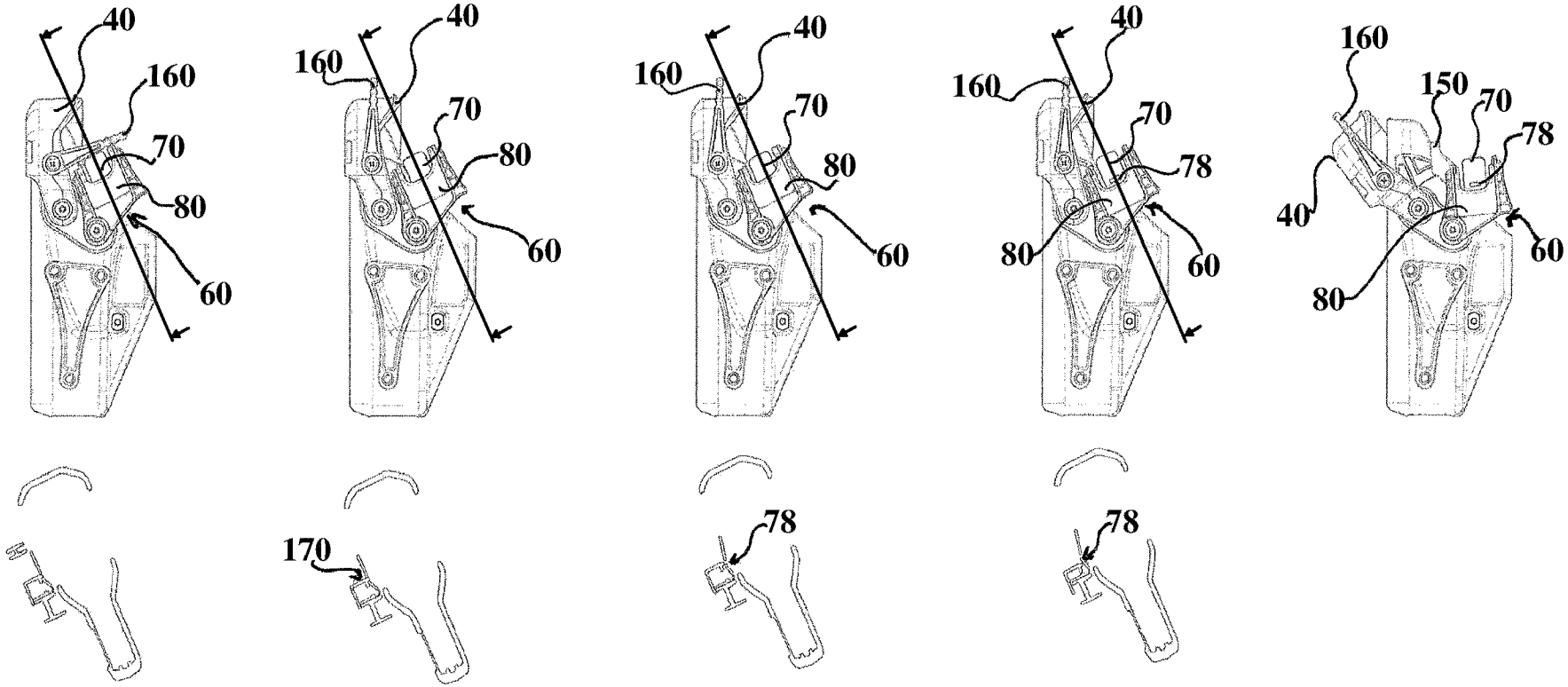
FIGS. 5A to 5E are a series of side and sectional views showing the retaining mechanism respectively moving from the retaining condition to the retracted condition.

The manner in which the retaining mechanism 10 may be utilised will now be described with reference to FIGS. 2 to 5. Referring to FIGS. 2 and 5A initially, it can be seen that the hood unit 40 is in the retaining condition. As described above, in this position, the hood unit 40 is configured to overlie a service item (not shown) in a holster to which the retaining mechanism 10 is integral with (or optionally mounted to) to prevent withdrawal of the service item. Referring to the sectional view in FIG. 2 particularly, it can be seen that (i) the lateral projection 170 of the U-shaped button 80 is received in the transverse slot 78 of the resilient L-shaped tab 70 to thereby releasably lock the U-shaped button 80 against depression (also see the sectional view in FIG. 5B); and (ii) the elongate tapered projection 150 of the U-shaped button 80 is located in the lock cavity 130 and is "sandwiched" between, and releasably restrained from movement by, the catch/detent 128 of the hood unit 40 on one side and the elongate tapered projection 110 of the housing 20 on an opposite side (also see FIG. 14).

Advantageously, in this position, the catch/detent 128 and the tapered housing projection 110 positively lock the lever assembly 60 (via tapered projection 150) against rearward rotation and thereby the hood unit 40 from forward rotation.

The bearer of the holster and retaining mechanism 10 may now actuate the lever assembly 60 to withdraw the service item from the holster. This procedure is illustrated in FIGS. 5A to 5E.

Referring to FIG. 5B, the blocking element or flap 160 has been moved from the blocking position (FIG. 5A) to the open position so that the U-shaped button 80 and tab 70 are readily accessible to the bearer. In FIG. 5C, the first, deflectable, portion 72 of L-shaped tab 70 has been deflected in a first action such that the lateral projection 170 of the button 80 has been removed from engagement within the transverse slot 78 of the tab 70 (see the sectional view in FIG. 5C). In FIG. 5D, the U-shaped button 80 has been depressed in a second subsequent action to withdraw the lever assembly projection 150 from engagement with the catch/detent 128 of the hood unit 40 (also see FIG. 3). Advantageously, the L-shaped tab 70 and the button 80 are respectively selectively deflectable and depressible by a single digit, preferably the thumb, in a substantially continuous movement. Lastly, in FIG. 5E, the lever assembly 60 is rotated rearwardly (via the thumb received in the U-shaped seat 82 of the button 80) to effect rotation of the hood unit 40 to its forwardly retracted condition (also see FIG. 4). In this position, the service item may be withdrawn from the holster (not shown).

After use, the service item may be relocated within the holster and the hood unit 40 may be returned to the retaining condition. To this end, the lever assembly 60 may be rotated forwardly such that the hood unit 40 rotates rearwardly to a home position corresponding to the retaining condition wherein the second restoring bias force (provided by the spring within the lever assembly 60) causes (i) the projection 150 of the U-shaped button 80 to engage the catch/detent 128 of the hood unit 40; and (ii) the lateral projection 170 to be located within the transverse slot 78 of the tab 70. The hood unit 40 may also be returned to the retaining condition by the bearer grasping on the hood unit and rearwardly rotating the hood unit. Alternatively, the hood unit 40 may be returned to the retaining condition by rearwardly rotating flap 160 which simultaneously rearwardly rotates hood unit 40. This has the benefit of guaranteeing flap 160 is returned to the blocking condition as the hood unit 40 is returned to the retaining condition.

The illustrated retaining mechanism 10 provides a safe and effective system for retaining a holstered service item. Advantageously, as the mechanism at least requires the user to selectively deflect and depress first and second lever portions in respective first and second actions and then rotate the lever assembly in a third action, the mechanism is not easily usable by an untrained adverse person.

Additionally, it will be appreciated that flap 160, deflectable tab 70, and depressible button 80 may be actuated by a single digit, preferably the thumb, in a substantially continuous smooth motion all while the bearer's hand maintains a very firm controlling grip on the handgun in the holster. When the gun is re-instated to its holster, a quick flick of either the lever assembly 60, hood unit 40 or flap 160 will return the retaining mechanism to its home retaining condition. At no time does the bearer have to remove or alter his or her grip on the weapon while operating the retaining mechanism.

Additionally, the very positive locking engagement between lever projection 150, catch/detent 128, and housing projection 110 in the retaining condition, and the counter-rotational engagement between pinion/gear teeth 30*b*, 32*b*, help guard against any attempt to pull hood unit 40 forwardly, or to force back lever assembly 60. If an adverse person in front of the bearer reaches over the holster and gun and does succeed in rotating flap 160 to the open position, deflecting tab 70, and depressing button 80, his hand will be in such a position that the subsequent attempted forward rotation of the hood unit 40 or rearward rotation of lever assembly 60 will be physically opposed by the position of his own hand. This situation will at least delay and confuse the attempt to extract the handgun, giving crucial advantage to the bearer of the holstered gun. Additionally, during an attack from the front, the adversary is likely to move flap 160 to the blocking position if it is located in the open position, thereby further delaying and confusing the attempt to extract the handgun. It will be understood that the invention disclosed and defined in this specification extends to all alternative combinations of two or more of the individual features mentioned or evident from the text or drawings. All of these different combinations constitute various alternative aspects of the invention.

The invention claimed is:

1. A retaining mechanism for a holster, comprising:

a body mountable to or integral with a holster;

a hood unit rotatably mounted to the body, the hood unit configured for rotation about a first axis between a retaining condition in which it overlies a service item in the holster to prevent its withdrawal and a retracted condition in which the service item can be withdrawn; and a hand-operable lever assembly rotatably mounted to the body and configured for rotation about a second axis, the lever assembly operably engageable with the hood unit whereby selective rotation of the lever assembly effects said rotation of the hood unit to its retracted condition and vice versa;

wherein the lever assembly includes a first, deflectable, portion and a separate second, depressible, portion, the first and second portions respectively selectively deflectable and depressible against respective first and second restoring bias forces to disengage the lever assembly from a lock formation configured to lock the lever assembly against said selective rotation and thereby the hood unit against said rotation to its retracted condition;

wherein the first portion is selectively deflectable in a first action to allow the second portion to be selectively depressible in a second subsequent action.

2. A retaining mechanism according to claim 1 wherein the first portion releasably locks the second portion to prevent the second portion from being depressed until the first portion is deflected in the first action.

3. A retaining mechanism according to claim 1 wherein the first portion is selectively deflectable in a first direction and the second portion is selectively depressible in a second direction, the first direction being generally perpendicular to the second direction.

4. A retaining mechanism according to claim 1 wherein the first and second portions are respectively selectively deflectable and depressible by a single digit, in a substantially continuous movement.

5. A retaining mechanism according to claim 4 wherein the subsequent rotation of the lever assembly to rotate the hood unit to its retracted condition is effected in said substantially continuous movement.

6. A retaining mechanism according to claim 1 wherein the first, deflectable, portion comprises a generally resilient material, which resilience advantageously provides the first restoring bias force.

7. A retaining mechanism according to claim 6 wherein the first portion is in the form of a generally L-shaped tab.

8. A retaining mechanism according to claim 1 wherein the second, depressible, portion is fitted at the outer end of, and is slidably mounted on, an elongate body of the lever assembly.

9. A retaining mechanism according to claim 8 wherein the second portion is in the form of a generally U-shaped button dimensioned to receive a thumb.

10. A retaining mechanism according to claim 1 wherein said second restoring bias force is provided by an internal compressible spring.

11. A retaining mechanism according to claim 1 in which the arrangement is such that when the lever assembly is rotated, either by direct hand engagement or by rotation of the hood unit, the second restoring bias force snaps the lever assembly back into engagement with the lock formation when it reaches a home position corresponding to the retaining condition of the hood unit.

12. A retaining mechanism according to claim 1 wherein the lock formation is provided by the hood unit.

13. A retaining mechanism according to claim 12 wherein the lock formation is a catch or detent that releasably engages a projection on the lever assembly in the retaining condition.

14. A retaining mechanism for a holster, comprising:

a body mountable to or integral with a holster;

a hood unit rotatably mounted to the body, the hood unit configured for rotation about a first axis between a retaining condition in which it overlies a service item in the holster to prevent its withdrawal and a retracted condition in which the service item can be withdrawn; and a hand-operable lever assembly rotatably mounted to the body and configured for rotation about a second axis, the lever assembly operably engageable with the hood unit whereby selective rotation of the lever assembly effects said rotation of the hood unit to its retracted condition and vice versa;

wherein in the retaining condition, a portion of the lever assembly is located between and releasably restrained from movement by a portion of the hood unit and a portion of the body, the hood unit portion and the body portion configured to positively lock the lever assembly against said selective rotation and thereby the hood unit against said rotation to its retracted condition; wherein the lever assembly includes a first, deflectable, portion and a separate second, depressible, portion, the first and second portions respectively selectively deflectable and depressible against respective first and second restoring bias forces to disengage the lever assembly from a lock formation configured to lock the lever assembly against said selective rotation and thereby the hood unit against said rotation to its retracted condition;

wherein the first portion is selectively deflectable in a first action to allow the second portion to be selectively depressible in a second subsequent action.

15. A retaining mechanism according to claim 14 wherein the body has a body elongate projection and the lever assembly has a lever assembly elongate projection, and the lever assembly elongate projection of the lever assembly or a portion thereof is located or sandwiched between the body elongate projection and the catch or detent of the hood unit to thereby positively lock and releasably restrain the lever assembly and hood unit from movement in the retaining condition.

16. A retaining mechanism according to claim 14 wherein the lever assembly portion is disengaged from the hood unit portion and the body portion to effect said rotation of the lever assembly and thereby said rotation of the hood unit to its retracted condition.

* * * * *